US009236676B2

(12) United States Patent
Nakagishi

(10) Patent No.: US 9,236,676 B2
(45) Date of Patent: Jan. 12, 2016

(54) CONNECTOR TERMINAL HAVING A CYLINDRICAL TERMINAL INSERTION SECTION

(71) Applicant: Yazaki Corporation, Minato-ku, Tokyo (JP)

(72) Inventor: Takumi Nakagishi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/327,147

(22) Filed: Jul. 9, 2014

(65) Prior Publication Data

US 2015/0017844 A1 Jan. 15, 2015

(30) Foreign Application Priority Data

Jul. 12, 2013 (JP) ..... 2013-146484

(51) Int. Cl.

| | |
|---|---|
| ***H01R 4/48*** | (2006.01) |
| ***H01R 13/187*** | (2006.01) |
| ***H01R 13/11*** | (2006.01) |
| *H01R 43/20* | (2006.01) |

(52) U.S. Cl.

CPC ..... *H01R 13/187* (2013.01); *H01R 13/113* (2013.01); *H01R 43/20* (2013.01)

(58) Field of Classification Search

CPC ..... H01R 4/48; H01R 13/113; H01R 13/187; H01R 43/20

USPC ..... 439/862

See application file for complete search history.

(56) References Cited

U.S. PATENT DOCUMENTS

| | | | | |
|---|---|---|---|---|
| 6,319,076 | B1 * | 11/2001 | Gollhofer et al. | 439/862 |
| 2003/0096533 | A1 | 5/2003 | Kojima et al. | |
| 2003/0096538 | A1 | 5/2003 | Kojima et al. | |

FOREIGN PATENT DOCUMENTS

| | | | |
|---|---|---|---|
| JP | 2006-228759 | A | 8/2006 |
| JP | 2010-073440 | A | 4/2010 |
| JP | 2012-038553 | A | 2/2012 |

* cited by examiner

*Primary Examiner* — Javaid Nasri
(74) *Attorney, Agent, or Firm* — Sughrue Mion, PLLC

(57) ABSTRACT

A connector includes a connector terminal electrically connected with a terminal (a counterpart terminal) of a counterpart component and a connector housing holding therein the connector terminal. The connector terminal includes a cylindrical terminal insertion section into which the counterpart terminal is to be inserted, a spring section which is brought into contact with the counterpart terminal in a cylinder of the terminal insertion section, and a displacement restriction section restricting excessive displacement of the spring section in the cylinder of the terminal insertion section when the spring section is brought into contact with the counterpart terminal, and the displacement restriction section includes a stabilizer which extends outward from the terminal insertion section while being supported continuously to a restriction part for the spring section.

1 Claim, 5 Drawing Sheets

CONNECTOR TERMINAL HAVING A CYLINDRICAL TERMINAL INSERTION SECTION

BACKGROUND

1. Technical Field

The present invention relates to a connector which is to be electrically connected with a counterpart component (for example, each of various kinds of electronic components mounted on a vehicle such as an automobile) and specifically relates to a terminal structure of a connector terminal.

2. Related Art

Patent Document 1 discloses one configuration example of such a connector. The connector disclosed in Patent Document 1 includes a connector terminal to be connected with a terminal of a counterpart component and a connector housing holding therein the connector terminal. In addition, the connector terminal includes a cylindrical terminal insertion section into which the terminal (a counterpart terminal) of the counterpart component is to be inserted and a spring section which is brought into contact with the counterpart terminal in a cylinder of the terminal insertion section.

In addition, in some cases, the connector terminal is provided with a member (a stabilizer member) adapted to promote prevention of improper assembly when assembling the connector terminal to the connector housing, posture stabilization after the assembly, an improvement in rigidity of the terminal and so forth as disclosed, for example, in Patent Document 1 and Patent Document 2. In addition, as disclosed in Patent Document 3, in some cases, the connector terminal includes a member (a displacement restriction member) adapted to restrict excessive displacement of the spring section when the spring section is brought into contact with the counterpart terminal. Further, there is also known a connector terminal configuration that a slip-out prevention member (such as, for example, a locking section or the like which is engageable with a spring piece (a lance) provided on the connector housing) is included in order to promote slip-out prevention after the assembly to the connector housing.

PRIOR ART DOCUMENT

Patent Document

[Patent Document 1] Japanese Patent Application Publication No. 2012-38553

[Patent Document 2] Japanese Patent Application Publication No. 2006-228759

[Patent Document 3] Japanese Patent Application Publication No. 2010-73440

DISCLOSURE OF THE INVENTION

Problems to be Solved by the Invention

Incidentally, it is desired to miniaturize a connector which is to be connected with a miniaturized counterpart component in accordance with the size of the counterpart component. In a case where the connector terminal includes such the stabilizer member, displacement restriction member and slip-out prevention member as mentioned above, it is necessary to secure a space for installing these members and to save the space for installation of these members, which becomes a problem in order to promote prevention of an increase in terminal size. For example, in a case where the stabilizer member, the displacement restriction member and the slip-out prevention member are individually arranged side by side with the terminal insertion section in an assembling direction of the connector terminal to the connector housing, the terminal size in the assembling direction is increased and enlargement of the connector is induced consequently.

SUMMARY

The present invention has been made in view of the above mentioned circumstances and a problem to be solved lies in that miniaturization of the connector is promoted without increasing the terminal size.

Means to Solve the Invention

In order to solve the above-mentioned problem, a connector according to an embodiment of the present invention includes a connector terminal electrically connected with a terminal of a counterpart component and a connector housing holding therein the connector terminal, wherein the connector terminal includes a cylindrical connector insertion section into which the terminal of the counterpart component is to be inserted, a spring section which is brought into contact with the terminal in a cylinder of the terminal insertion section, and a displacement restriction section restricting excessive displacement of the spring section in the cylinder of the terminal insertion section when the spring section is brought into contact with the terminal, and the displacement restriction section includes a stabilizer which extends outward from the terminal insertion section while being supported continuously to a restriction part for the spring unit.

According to the connector pertaining to the embodiment of the present invention, it is possible to form the displacement restriction section such that the size of the displacement restriction section is confined within the size of the terminal insertion section in the assembling direction of the connector terminal to the connector housing. Accordingly, it becomes unnecessary to increase the terminal size in the assembling direction by forming the stabilizer continuously to the displacement restriction section so confined in size even in a case where the connector terminal includes the displacement restriction section and the stabilizer.

In this case, such a configuration may be employed that the connector housing is provided with a lance adapted to restrict movement of the terminal of the counterpart component which has been inserted into the terminal insertion section in a slipping-out direction and a locking hole which is engageable with the lance is formed in the terminal insertion section. Owing to this configuration, it is not necessary to provide a member having the locking hole separately from the terminal insertion section, it is not necessary to increase the terminal size in the assembling direction of the connector terminal to the connector housing regardless of provision of the locking hole in the connector terminal, and therefore, it becomes possible to promote prevention of slipping of the connector terminal out of the connector housing by adjusting the position of the lance to be provided on the connector housing and bringing the lance into engagement with the locking hole.

DETAILED DESCRIPTION

Embodiments of a connector according to the present invention will be described below with reference to the drawings. The connector according to one embodiment of the present invention is an interface component which is to be electrically connected with a counterpart component (for example, each of various kinds of electronic components mounted on the vehicle such as the automobile). In this case, the connector is configured to be connected with the counterpart component by inserting a terminal (hereinafter, referred to as a counterpart terminal) provided on the counterpart component into the connector.

Figure 1:
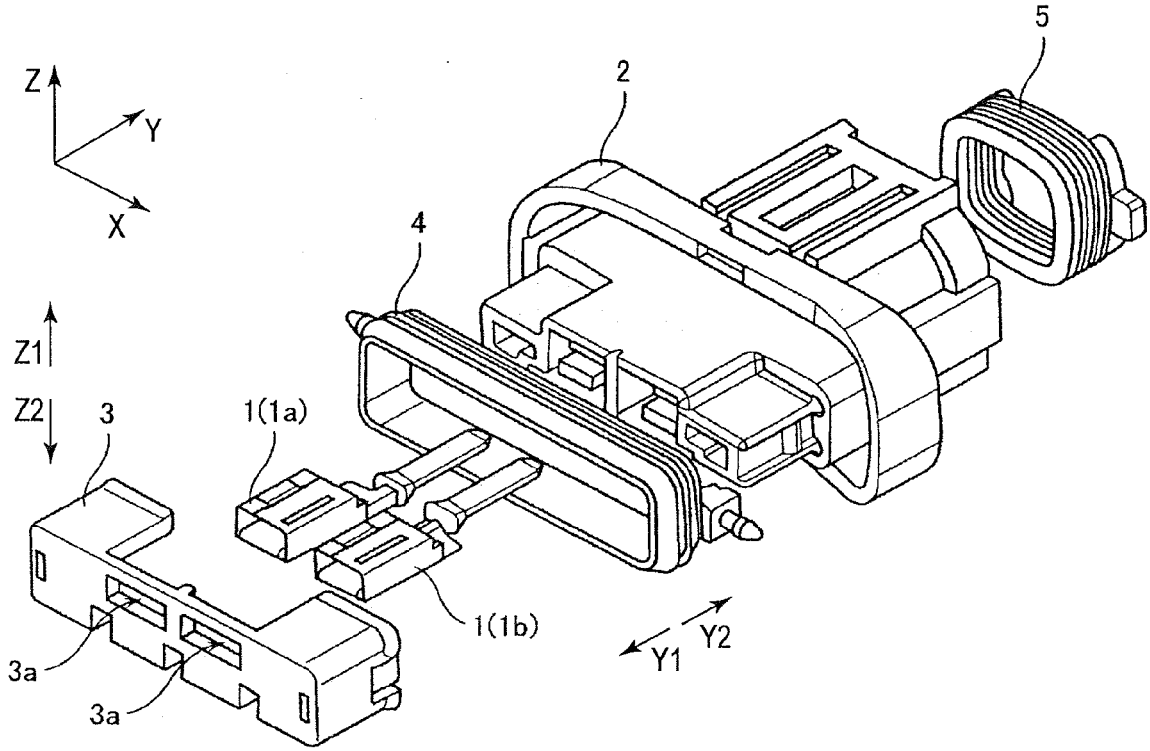
FIG. 1 is a perspective view illustrating a connector according to a first embodiment of the present invention by breaking up the connector to component members.
Figure 2:
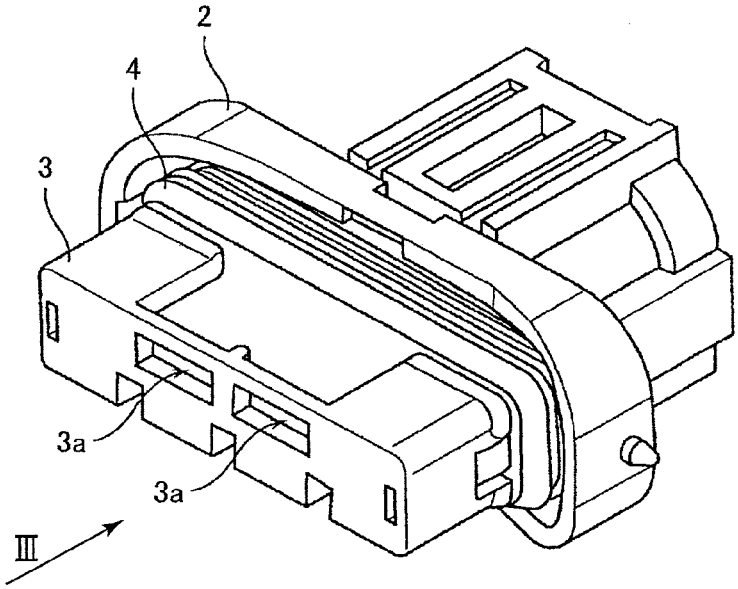
FIG. 2 is a general perspective view of the connector illustrating a state that the component members illustrated in FIG. 1 have been assembled.
Figure 3:
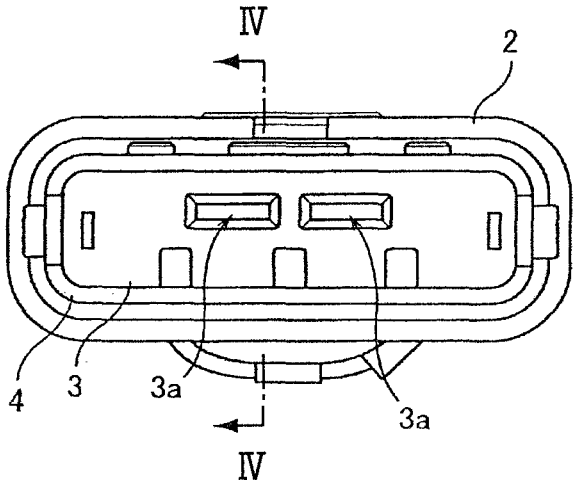
FIG. 3 is a diagram (a front view of the connector) illustrating the connector when viewed in a direction of an arrow III in FIG. 2.
Figure 4:
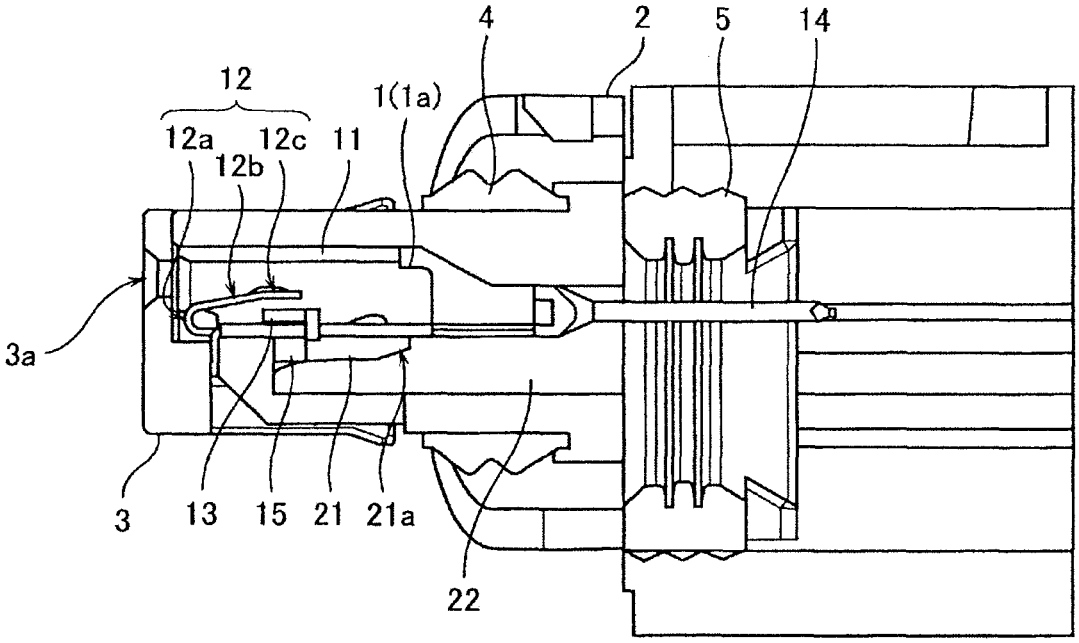
FIG. 4 is a diagram illustrating a longitudinal section of the connector along a IV-IV line in FIG. 3, when viewed in an arrow direction in FIG. 3.

FIG. 1 to FIG. 4 illustrate examples of the configuration of the connector according to the first embodiment of the present invention. FIG. 1 is a perspective view illustrating the connector according to the first embodiment by breaking up the connector for each component member. FIG. 2 is a perspective view illustrating the general configuration of the connector configured by assembling the component members illustrated in FIG. 1. FIG. 3 is a diagram (a front view of the connector) illustrating the connector when viewed in the direction of the arrow III in FIG. 2. FIG. 4 is a diagram illustrating the longitudinal section of the connector along the IV-IV line in FIG. 3 when viewed from the arrow direction. In the following description, an arrow X direction will be referred to as a right-left direction, an arrow Y direction will be referred to as a front-back direction and an arrow Z direction will be referred to as a vertical direction in FIG. 1. Incidentally, with respect to the front-back direction, an arrow Y1 direction will be specified as the front side (forward) and an arrow Y2 direction will be specified as the back side (backward) in FIG. 1, and with respect to the vertical direction, an arrow Z1 direction will be specified as the upper side (upward) and an arrow Z2 direction will be specified as the lower side (downward) in FIG. 1. However, these right-left direction, front-back direction and vertical direction may not necessarily match respective directions in a state that the connector has been actually connected with the counterpart component.

As illustrated in FIG. 1 to FIG. 4, the connector includes a connector terminal 1 (1*a*, 1*b*) electrically connected with the terminal (the counterpart terminal) of the counterpart component (not illustrated) and a connector housing 2 holding therein the connector terminal 1. In addition, a holder member 3 (hereinafter, referred to as a front holder) positioning and fixing the connector terminal 1 to the connector housing 2 on the side (forward in the front-back direction) that the connector terminal 1 is connected with the counterpart component is attached to the connector and annular seal members 4 and 5 (hereinafter, referred to as packing) preventing intrusion of water into the connector are attached between the front holder 3 and the connector housing 2 and to the back side of the connector housing 2, respectively. Incidentally, a configuration that one connector is provided with the two connector terminals 1*a* and 1*b* is illustrated in FIG. 1 and FIG. 2 by way of example. However, the number of the connector terminals that the connector includes may be set in accordance with a connection mode of the connector with the counterpart component and either only one or three or more connector terminals may be provided.

Figure 5:
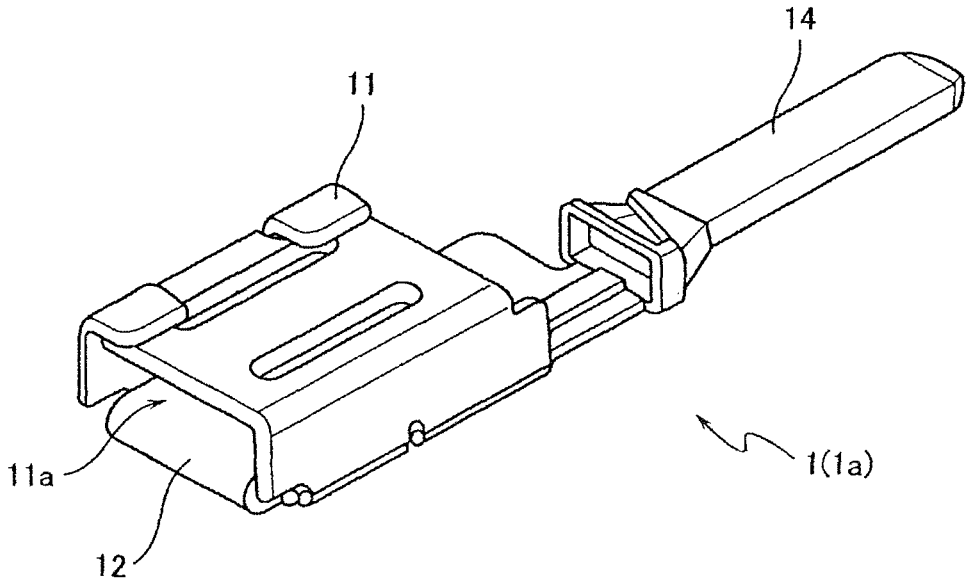
FIG. 5 is a perspective view illustrating a general configuration of a connector terminal according to the first embodiment of the present invention.
Figure 6:
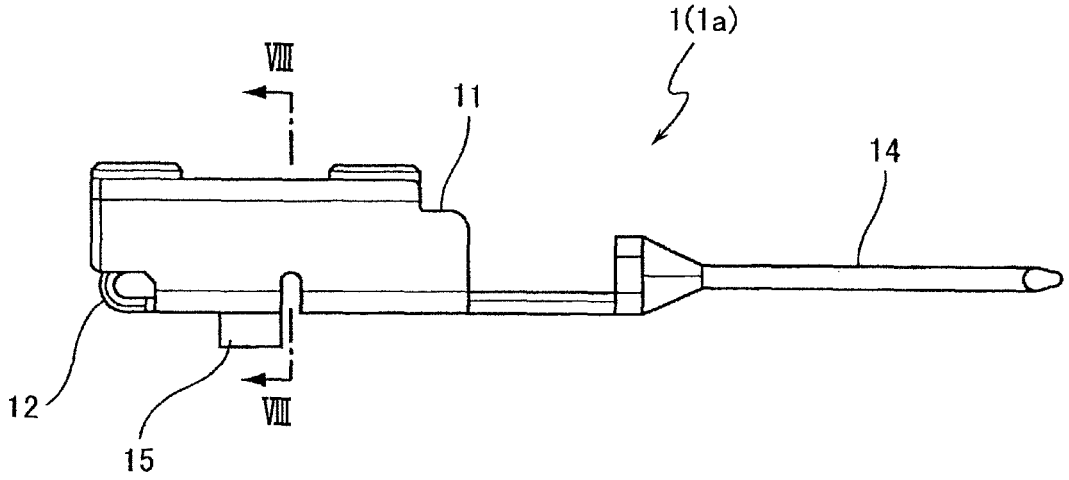
FIG. 6 is a one-side view of the connector terminal according to the first embodiment of the present invention.
Figure 7:
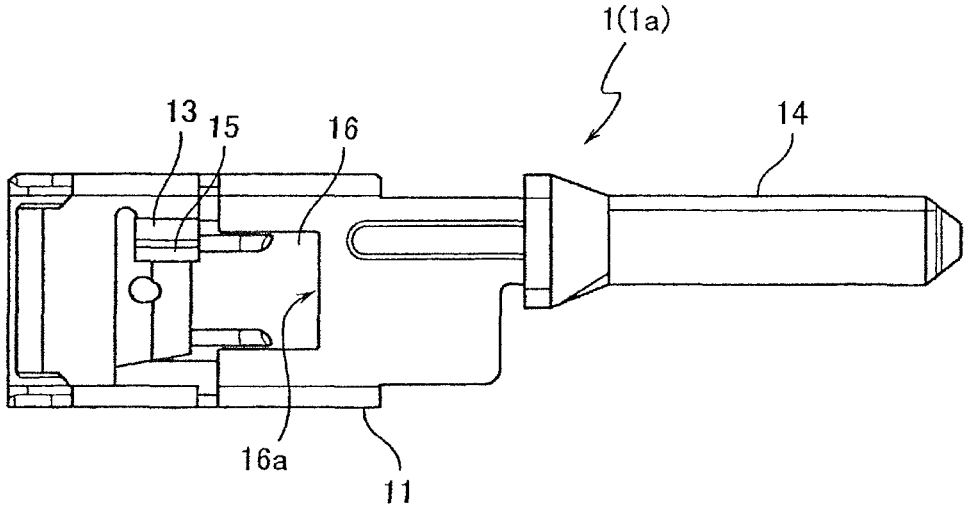
FIG. 7 is a bottom view of the connector terminal according to the first embodiment of the present invention.
Figure 8:
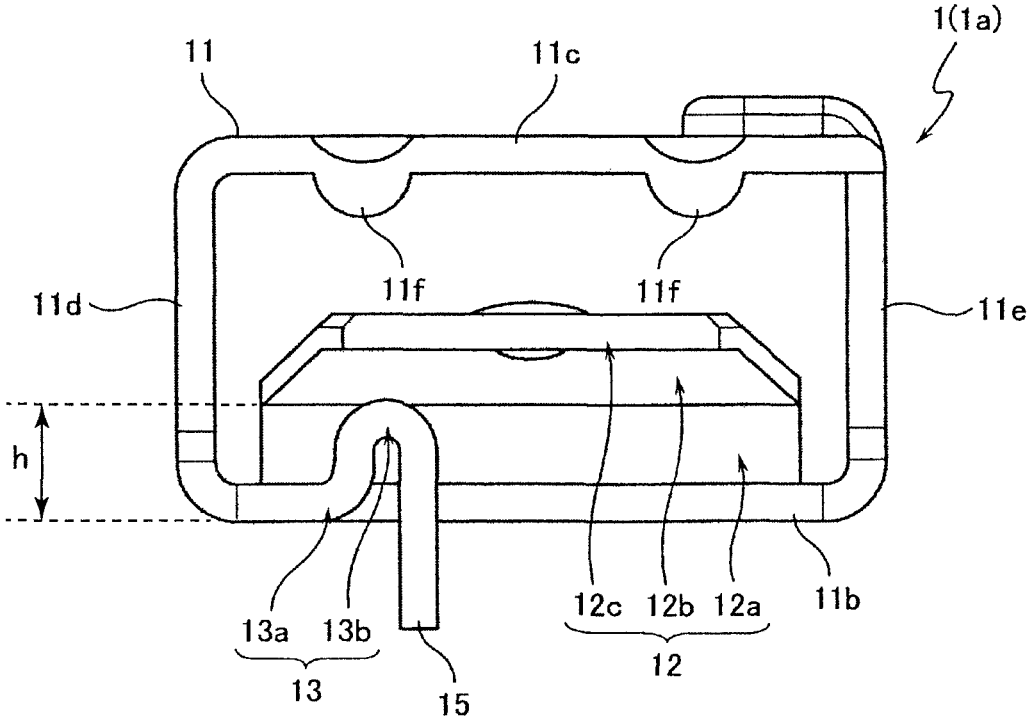
FIG. 8 is a diagram illustrating a longitudinal section of the connector terminal along a VIII-VIII line in FIG. 6, when viewed in an arrow direction in FIG. 6.

FIG. 5 to FIG. 8 illustrate examples of the configuration of the connector terminal 1 (1*a*). FIG. 5 is a perspective view illustrating the general configuration of the connector terminal 1, FIG. 6 is a one-side view of the connector terminal 1 in the right-left direction, FIG. 7 is a bottom view of the connector terminal 1 and FIG. 8 is a diagram illustrating the longitudinal section of the connector terminal 1 along the VIII-VIII line in FIG. 6 when viewed in the arrow direction in FIG. 6.

The connector terminal 1 (1*a*) includes a cylindrical terminal insertion section 11 into which the counterpart terminal is to be inserted, a spring section 12 which is brought into contact with the counterpart terminal in a cylinder of the terminal insertion section 11 and a displacement restriction section 13 restricting excessive displacement of the spring section 12 in the cylinder of the terminal insertion section 11 when the spring section 12 is brought into contact with the counterpart terminal. In addition, the connector terminal 1 includes a contact section 14 connected with an electric wire and so forth on the back side (the side opposite to the side that the connector is connected with the counterpart component) of the connector and the contact section 14 extends backward continuously to the terminal insertion section 11. Incidentally, the two connector terminals 1*a* and 1*b* may be formed to have the same shape, but the connector terminals may be also formed such that, for example, they have basically the same shape and the positions of the contact sections 14 relative to the terminal insertion sections 11 are made different from each other in the right-left direction. In the present embodiment, description will be made by giving the connector terminal 1*a* as one form of the connector terminal 1.

The terminal insertion section 11 is formed into a cylindrical shape capable of insertion of the counterpart component coping with the form of the counterpart terminal and is configured such that the counterpart terminal is inserted into the cylinder through a front opening (hereinafter, referred to as an insertion opening 11*a*). Incidentally, an opening (hereinafter, referred to as a front hole 3*a*) communicatable with the insertion opening 11*a* in a state that the front holder 3 is attached to the front side of the connector so as to cover the connector terminal 1 is formed in the front holder 3. Thus, the counterpart terminal is inserted into the terminal insertion section 11 through the front hole 3*a* and the insertion opening 11*a* which communicate with each other. Here, the terminal insertion section 11 which is configured to have such a square cylindrical shape as to have an inner space which is rectangular in longitudinal section on the assumption that the counterpart terminal has a rectangular (tabular) longitudinal section (a section which is parallel with the vertical and right-left directions) is illustrated in FIG. 5 to FIG. 8 by way of example.

However, it is also conceivable to configure the terminal insertion section 11 to have such a cylindrical shape as to have an inner space which is circular in longitudinal section so as to allow insertion of, for example, a so-called pin type counterpart component.

The terminal insertion section 11 according to the present embodiment is formed by bending a thin-plate-shaped member (for example, a metal plate) and includes a bottom wall 11*b* and a top wall 11*c* which mutually face in the vertical direction and side walls 11*d* and 11*e* which mutually face in the right-left direction. The bottom wall 11*b*, the top wall 11*c* and the side walls 11*d* and 11*e* are formed continuously in a convex shape (a so called R-shape). A projection 11*f* for stabilizing the posture of the counterpart terminal which has been inserted into the terminal insertion section 11 between the top wall 11*c* and the spring section 12 is fo ned on an inner surface of the top wall 11*c* so as to project downward toward the spring section 12.

The spring section 12 is supported continuously to a front end part (hereinafter, referred to as a spring base end part 12*a*) of the bottom wall 11*b* of the terminal insertion section 11 and is folded backward from the front end part, and an extending end thereof extends in a tabular shape so as to be positioned in the cylinder of the terminal insertion section 11 (hereinafter, the tabular extending part will be referred to as a spring leaf part 12*b*). The spring leaf part 12*b* extends from the spring base end part 12*a* obliquely upward so as to approach the top wall 11*c*, is thereafter bent so as to run in parallel with the top wall 11*c* and extends outward (hereinafter, a part which runs in parallel with the top wall 11*c* will be referred to as a spring contact part 12*c*). Thus, the spring section 12 exhibits a so-called cantilever spring shape and is configured such that the spring leaf part 12*b* is made elastically deflectable and deformable in the vertical direction using the spring base end part 12*a* as a base point. In a case where the counterpart terminal has been inserted through the insertion opening 11*a*, the spring leaf part 12*b* is elastically deflected and deformed downward by being depressed by the inserted counterpart terminal. Then, when the counterpart terminal further enters the cylinder of the terminal insertion section 11 and is placed in an appropriate position, the spring leaf part 12*b* presses the counterpart terminal in the cylinder toward the projection 11*f* with force which works to elastically deflect, restore and deform upward the spring leaf part 12*b*. As a result, the spring leaf part 12*b* comes into contact with the counterpart terminal in the cylinder of the terminal insertion section at the spring contact part 12*c*. A distance between the spring contact part 12*c* and the projection 11*f* may be set in accordance with, for example, a form (a thickness by way of example) of the counterpart terminal and the elastically deflecting and deforming force (pressing force) of the spring leaf part 12*b* such that the pressed counterpart terminal is brought into appropriate contact and conduction with the spring contact part 12*c*.

The displacement restriction section 13 is supported in parallel with the front-back direction continuously to the bottom wall 11*b* of the terminal insertion section 11. As illustrated in FIG. 7 and FIG. 8, the displacement restriction section 13 is formed by bending upward a part (hereinafter, the part so bent will be referred to as a restriction section base end 13*a*) which is closer to a one-side side wall (closer to the left-side side wall 11*d* in FIG. 8) than a central part in the right-left direction of the bottom wall 11*b* and is more forward than a central part in the front-back direction of the bottom wall 11*b* and folding back downward a bent end thereof (hereinafter, referred to as a restriction section leading end 13*b*). The restriction section base end 13*a* is formed continuously to the bottom wall 11*b* in the convex shape (the so-called R-shape). In addition, the restriction section leading end 13*b* is formed to exhibit an upward projecting convex shape and is configured to come into smooth contact with the spring leaf part 12*b* (the spring contact part 12*c*) which has been elastically deflected and deformed by the counterpart terminal inserted into the terminal insertion section 11. The displacement restriction section 13 suppresses downward and more excessive elastic deflection and deformation of the spring leaf part 12*b* (the spring contact part 12*c*) by bringing the restriction section leading end 13*b* into contact with the spring contact part 12*c* as described above. A length (a dimension in the front-back direction) of the displacement restriction section 13 is made shorter than a length of the terminal insertion section 11 and a size of the displacement restriction section 13 is set such that it is possible to exert pressing force from the spring contact part 12*c* which has been elastically deflected and deformed and brought into contact with the restriction section leading end 13*b* onto the displacement restriction section 13 and it is possible to reliably suppress excessive downward displacement of the spring contact part 12*c*. In addition, a distance between the displacement restriction section 13 (the restriction section leading end 13*b*) and the spring contact part 12*c*, in other words, a height h (a height measured from the restriction section base end 13*a* up to the restriction section leading end 13*b*) that the displacement restriction section 13 is bent upward from the bottom wall 11*b* is set so as to secure a required minimum deflection margin (a downward deflecting space) of the spring leaf part 12*b* for elastically deflecting and deforming the spring leaf part 12*b* (the spring contact part 12*c*) to smoothly insert the counterpart terminal into the terminal insertion section 11. Thus, in a case where the spring leaf part 12*b* (the spring contact part 12*c*) displaces beyond the required minimum deflecting margin, it is possible to immediately bring the spring contact part 12*c* into contact with the displacement restriction section 13 and it is possible to smoothly insert the counterpart terminal into the terminal insertion section 11. That is, since excessive displacement of the spring leaf part 12*b* (the spring contact part 12*c*) does not occur when inserting the counterpart terminal into the terminal insertion section 11, it is possible to prevent damage to the spring leaf part 12*b* and to maintain an appropriate contact state (a contact pressure applied state) of the spring contact part 12*c* with the counterpart terminal over a long period of time.

Then, in the present embodiment, the displacement restriction section 13 includes a stabilizer 15 which extends outward from the terminal insertion section 11 while being supported continuously to a restriction portion (the restriction section leading end 13*b*) for the spring section 12. The stabilizer 15 is a member (an extension piece) adapted to promote prevention of improper assembly when assembling the connecter terminal 1 to the connector housing 2, posture stabilization of the connector terminal 1 after assembled, improvement in rigidity of the terminal and so forth. Therefore, an extension length of the stabilizer 15 from the terminal insertion section 11 is set so as to secure a dimension which is sufficient for performing above-mentioned functions. In the present embodiment, since the displacement restriction section 13 is formed to be confined within the dimension of the terminal insertion section 11 in the front-back direction, it is unnecessary to increase the terminal size in the front-back direction by forming the stabilizer 15 continuously to the displacement restriction section 13 even in a case where the connector terminal 1 includes the stabilizer 15. Incidentally, in the present embodiment, the stabilizer 15 is formed so as to extend downward from the bottom wall 11*b* of the terminal insertion section 11 while being supported continuously to the restriction section leading end 13*b* which has been formed by folding back from top to bottom (see FIG. 6 to FIG. 8). However, it is also conceivable to configure the stabilizer 15 so as to extend outward from any of the top wall 11*c* and the side walls 11*d* and 11*e* of the terminal insertion section 11 in accordance with the configuration mode of the displacement restriction section 13.

In addition, in the present embodiment, the connector housing 2 is provided with a lance 21 (see FIG. 4) adapted to restrict movement of the connector terminal 1 to a direction (forward in the front-back direction) that the connector terminal 1 slips out of the connector housing 2. On the other hand, a locking hole 16 which is engageable with the lance 21 is formed in the terminal insertion section 11.

The lance 21 is provided on a lower-side inner wall of a holding space (hereinafter, referred to as a terminal holding space 22) for holding the connector terminal 1 which is formed in the connector housing 2 by way of example. In this case, the lance 21 is extended backward from the front side (the side that the front holder 3 is mounted) of the terminal holding space 22 and an extending end 21*a* thereof is molded integrally with the connector housing 2 in the form of a cantilever spring which is engageable with the locking hole 16. Incidentally, the lances 21 may be formed for the connector housing 2 in the same number (two in the present embodiment by way of example) as the number of the connector terminals 1 that the connector housing 2 holds therein.

In a case where the connector terminal 1 has been inserted into the terminal holding space 22, the lance 21 is depressed by the inserted connector terminal 1 and is elastically deflected and deformed downward. Then, when the connector terminal 1 further enters the terminal holding space 22 and a front-side opening edge 16*a* of the locking hole 16 reaches the extending end 21*a* of the lance 21, the lance 21 is elastically deflected, restored and deformed upward to engage with the locking hole 16. Thus, the connector terminal 1 is locked with the lance 21 and it is possible to promote prevention of the connector terminal 1 from slipping out of the terminal holding space 22 (the connector housing 2). Then, the connector terminal 1 is positioned and fixed to the connector housing 2 by attaching the front holder 3 to the front side of the connector housing 2 while the connector terminal 1 is being locked with the lance 21 in the above-described manner.

The locking hole 16 is formed through the bottom wall 11*b* of the terminal insertion unit 11 on the side which is more backward than the displacement restriction section 13. The position and the size of the locking hole 16 are set such that locking hole 16 is engageable with the lance 21 when the connector terminal 1 has been inserted into the terminal holding space 22 in the connector housing 2. It is not necessary to increase the terminal size in the front-back direction by forming the locking hole 16 in the terminal insertion section 11 in the above-described manner even when the connector terminal 1 includes the locking hole 16 and it is possible to promote prevention of the connector terminal 1 from slipping out of the connector housing 2 by adjusting the position of the lance 21 in the connector housing to bring the lance 21 into engagement with the locking hole 16.

As described above, according to the connector pertaining to the present embodiment, it is possible to promote miniaturization of the connector without increasing the terminal size even in a case where the connector terminal 1 is provided with the stabilizer 15 and the locking hole 16. It is possible to reduce the terminal size in the front-back direction in comparison with, for example, a terminal structure that the stabilizer, the locking hole and the displacement restriction section are individually arranged side by side in the front-back direction and it is possible to miniaturize the connector by the amount of size reduction.

Although the present invention has been described hereinabove on the basis of the first embodiment as illustrated in FIG. 1 to FIG. 8, the above-mentioned embodiment is merely one example of the present invention and the present invention is not limited to the configuration of the above-mentioned first embodiment. Therefore, it is apparent for a person skilled in the art that it is possible to embody the present invention in forms which have been modified and/or altered within the scope of the gist of the present invention and it is obvious that the so modified and/or altered forms fall within the scope of the patent claims of the present invention.

Figure 9:
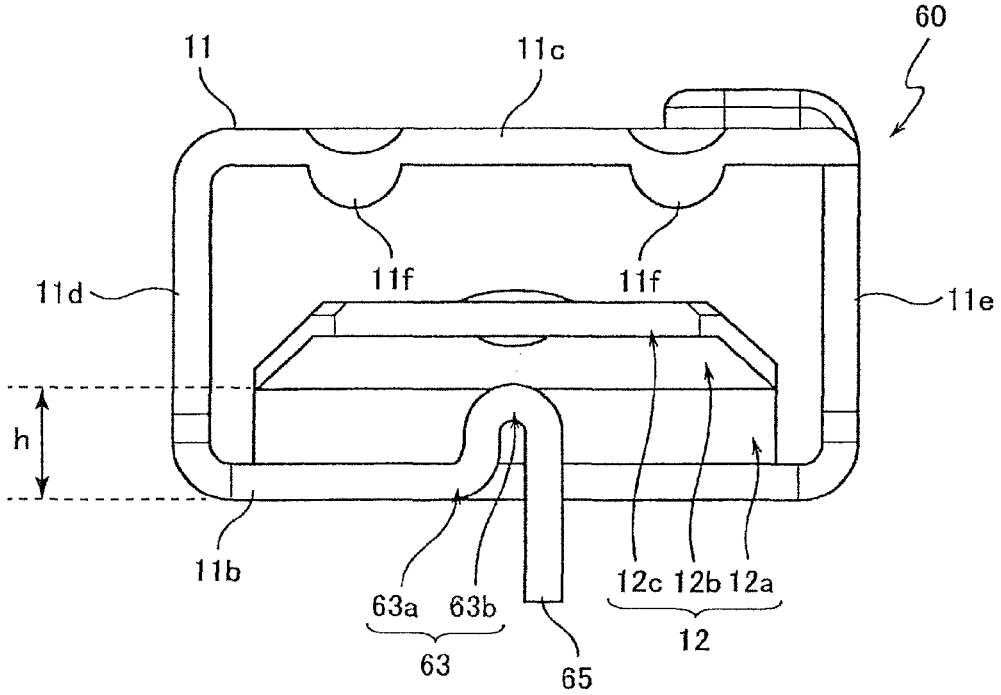
FIG. 9 is a cross-sectional view of a connector terminal according to a second embodiment of the present invention and corresponding to FIG. 8.
Figure 10:
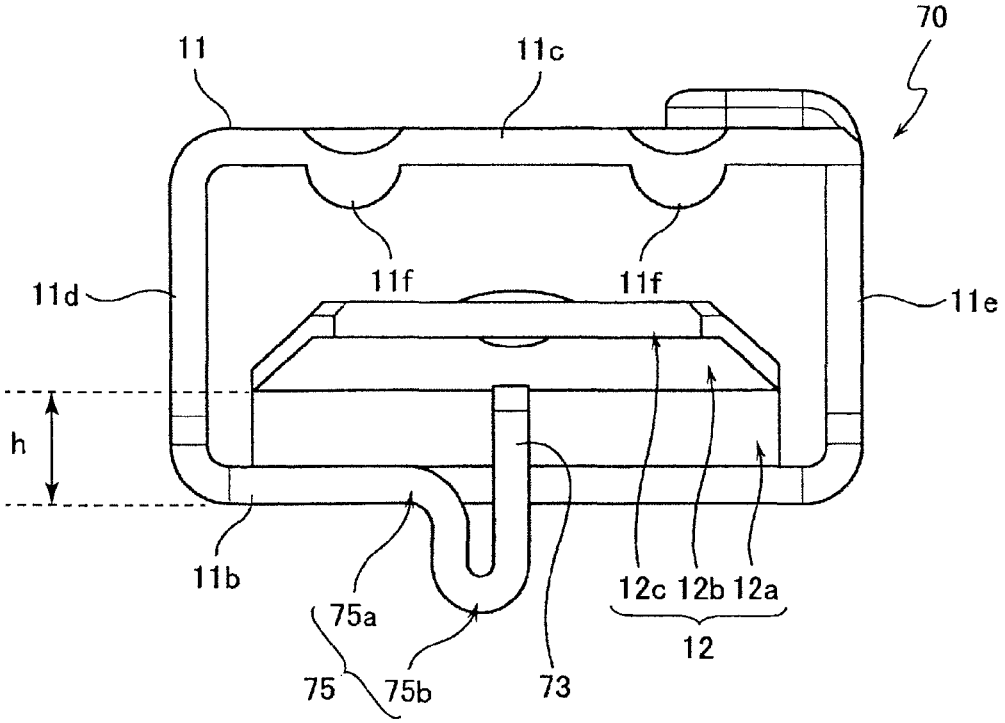
FIG. 10 is a cross-sectional view of a connector terminal according to a third embodiment of the present invention and corresponding to FIG. 8.

It is possible to achieve the same operation effects as those by the above-mentioned embodiment even in a case where the forms of the displacement restriction section and the stabilizer have been modified and/or altered, for example, as in a second embodiment illustrated in FIG. 9 and a third embodiment illustrated in FIG. 10. In the following, the second embodiment and the third embodiment will be described. Incidentally, in these embodiments, the basic configuration of the connector is the same as that in the first embodiment (FIG. 1 to FIG. 8). Description of the configurations which are the same as or similar to those in the above-mentioned embodiment is omitted by assigning the same numerals to these configurations in the drawings. In the following, points which are different from those in the first embodiment will be described.

FIG. 9 is a cross-sectional view of a connector terminal according to the second embodiment of the present invention and corresponding to FIG. 8. As illustrated in FIG. 9, in a displacement restriction section 63 of a connector terminal 60 according to the second embodiment, a part which is almost central in the right-left direction of the bottom wall 11*b* of the terminal insertion section 11 and is more forward than a central part in the front-back direction of the bottom wall 11*b* is bent upward to form a restriction section base end part 63*a* and a restriction section leading end 63*b* is formed by being folded back downward. Then, a stabilizer 65 is formed so as to extend outward from the terminal insertion section 11 while being supported continuously to the restriction section leading end 63*b* so formed. That is, the displacement restriction section 63 and the stabilizer 65 according to the second embodiment are configured to be positioned closer to the side wall 11*e* of the terminal insertion section 11 in the right-left direction (specifically, almost central parts in the right-left direction) in comparison with the displacement restriction section 13 and the stabilizer 15 according to the first embodiment.

FIG. 10 is a cross-sectional view of a connector terminal according to the third embodiment and corresponding to FIG. 8. As illustrated in FIG. 10, in a connector terminal 70 according to the third embodiment, a part which is slightly closer to a one-side side wall (closer to the left-side side wall 11*d* in FIG. 10) than a central part in the right-left direction of the bottom wall 11*b* of the terminal insertion section 11 and is more forward than a central part in the front-back direction is bent downward to form a stabilizer 75. Then, a leading end part (a lower end part) 75*b* of the stabilizer 75 so formed is folded back upward to form a displacement restriction section 73. In this case, a base end part 75*a* of the stabilizer 75 is formed continuous to the bottom wall 11*b* in the convex shape (the so-called R-shape) and the leading end part 75*b* which is to be a folded-back part is formed so as to exhibit a downward projecting convex shape. That is, in the present embodiment, the positional relation in the right-left direction between the displacement restriction section 73 and the stabilizer 75 is configured to be reverse (the displacement restriction section 73 is positioned on the side wall 11*e* side and the stabilizer 75 is positioned on the side wall 11*d* side) to that in the first embodiment.

In the first embodiment and the second embodiment, the displacement restriction sections 13 and 63 are disposed to extend relative to the bottom wall 11*b* and the stabilizers 15 and 65 are formed continuously to the displacement restriction sections 13 and 63 respectively. The third embodiment is different from the first embodiment and the second embodiment in that the stabilizer 75 is disposed to extend relative to the bottom wall 11*b* and the displacement restriction section 73 is formed continuously to the stabilizer 75.

The embodiments of the present invention have been described hereinabove, but these embodiments are merely illustration described for the purpose of facilitating the understanding of the present invention and the present invention is not limited to the embodiments. The technical scope of the present invention is not limited to the specific technical matters disclosed in the embodiments but includes various modifications, changes, alternative techniques, and the like which can readily be conceived therefrom.

The present patent application claims the priority based on Japanese Patent Application No. 2013-146484 which has been filed on Jul. 12, 2013 and the entire content thereof is incorporated herein by reference.

INDUSTRIAL APPLICABILITY

According to the embodiments of the present invention, it is possible to promote miniaturization of connector without increasing the connector terminal size.

REFERENCE SIGN LIST

1 connector terminal

2 connector housing

11 terminal insertion section

12 spring section

13 displacement restriction section

15 stabilizer

What is claimed is:

1. A connector comprising:

a connector terminal electrically connected with a terminal of a counterpart component; and a connector housing holding therein the connector terminal, wherein the connector terminal includes a cylindrical terminal insertion section into which the terminal of the counterpart component is to be inserted, a spring section which is brought into contact with the terminal in a cylinder of the terminal insertion section and a displacement restriction section restricting excessive displacement of the spring section in the cylinder of the terminal insertion section when the spring section is brought into contact with the terminal, and the displacement restriction section includes a stabilizer which extends outward from the terminal insertion section while being supported continuously to a restriction part for the spring section.

* * * * *